United States Patent [19]

Bergman et al.

[11] Patent Number: 5,050,232

[45] Date of Patent: Sep. 17, 1991

[54] MOVABLE HEAT TREATING APPARATUS UTILIZING PROPORTIONALLY CONTROLLED INFRARED LAMPS

[75] Inventors: Charles H. Bergman, Ham Lake; David E. Bannick, Roseville; Richard A. Stein, Rush City; Donald H. Wattenhofer, Fridley, all of Minn.

[73] Assignee: BGK Finishing Systems, Inc., Blaine, Minn.

[21] Appl. No.: 501,090

[22] Filed: Mar. 28, 1990

[51] Int. Cl.[5] ..... F26B 9/00

[52] U.S. Cl. ..... 392/412; 392/415; 392/411; 34/46; 34/4; 34/39; 219/483; 219/494

[58] Field of Search ..... 219/354–355, 219/358, 348–349, 483, 494; 392/411–413, 415; 34/39, 243 R, 43, 46, 4; 236/DIG. 8

[56] References Cited

U.S. PATENT DOCUMENTS

| | | | |
|---|---|---|---|
| 1,813,383 | 7/1931 | Chesney et al. | 392/412 |
| 3,646,319 | 2/1972 | Auld | 219/354 |
| 4,229,236 | 10/1980 | Heath | 148/128 |
| 4,256,127 | 3/1981 | Tsujimoto et al. | 219/483 |
| 4,258,731 | 3/1981 | Tsujimoto et al. | 219/364 |
| 4,541,442 | 9/1985 | Hollmann et al. | 34/39 |
| 4,620,884 | 11/1986 | Heath | 266/87 |
| 4,907,533 | 3/1990 | Nelson et al. . | |
| 4,914,273 | 4/1990 | Matsui | 219/358 |

FOREIGN PATENT DOCUMENTS

| | | |
|---|---|---|
| 450617 | 7/1936 | United Kingdom . |
| 2153507 | 8/1985 | United Kingdom . |

OTHER PUBLICATIONS

Brochure of Kwik Paint Products, Detroit, Mich.
Brochure of Thermal Devices Div, John J. Fannon Co., Inc., Mt. Clemens, Mich.

*Primary Examiner*—C. L. Albritton
*Assistant Examiner*—John A. Jeffery
*Attorney, Agent, or Firm*—Merchant, Gould, Smith, Edell, Welter & Schmidt

[57] ABSTRACT

An apparatus for heat treating the surface of a body includes at least one infrared lamp carried on a stand. A circuit is provided for controlling the energization of the lamp. The circuit includes a parameter input mechanism for permitting an operator to input at least one operating parameter to the circuit. The circuit also includes a proportional control software responsive to a temperature of the body being heat treated and responsive to a parameter inputted by the input mechanism.

7 Claims, 7 Drawing Sheets

82

LEFT THUMB WHEEL LEGEND

| | |
|---|---|
| PROCESS VARIABLE °F | 0 |
| SET POINT TEMPERATURE °F | 1 |
| POWER LIMIT % | 2 |
| TIME AT TEMPERATURE | 3 |
| PROPORTIONAL BAND % | 4 |
| MANUAL RESET % OF BAND | 5 |
| MANUAL IDLE % POWER | 6 |
| MANUAL CURE % POWER | 7 |
| WATTAGE VARIABLE / % POWER | 8 |
| ELAPSED TIME | 9 |

MOVABLE HEAT TREATING APPARATUS UTILIZING PROPORTIONALLY CONTROLLED INFRARED LAMPS

I. BACKGROUND OF THE INVENTION

1. Field of the Invention

This invention pertains to an infrared heater for heat treating a surface. More specifically, this invention pertains to such an apparatus having proportional controlled heating elements.

2. Background of the Invention

Apparatus for heat treating surfaces by infrared radiation are well known. Such apparatus are particularly useful in the automobile industry for touch-up repair of paint on an automobile surface.

One version of a prior art heating apparatus includes a mobile stand having an infrared heater attached to the stand. The stand is commonly provided on rollers so the stand may be rolled across a work surface toward and away from an automobile body. As a result, the infrared heater may be positioned adjacent to an area of the surface body to be heat treated. The prior art apparatus included adjustable arms for connecting the infrared heater to the stand so the infrared heater could be raised, lowered or pivoted relative to the stand.

The prior art apparatus as described had little control for the infrared heater. For example, the apparatus would typically have an on/off control and a timer. As a result, the heating elements were turned on for a set period of time. However, this limited amount of control is unsuitable. For example, this control does not account for the fact that there is a period of time required for the heating elements to achieve full power. Also, a period of time is required to heat up the surface to be treated to a desired temperature. Most critically, the prior apparatus was operated independent of the surface temperature of the article to be heat treated.

II. SUMMARY OF THE INVENTION

According to a preferred embodiment of the present invention, an apparatus is disclosed for heat treating a surface of a body. The apparatus includes a panel of infrared lamps. A stand is provided for mounting the lamps in at least one of a plurality of positions. A heat detector is provided for detecting a temperature of the surface to be heat treated. A circuit is provided for controlling the energization of the lamps. The circuit includes a parameter input mechanism for permitting an operator to input at least one operating parameter into the circuit. The circuit also includes a proportional controller responsive to the detected heat of the surface and responsive to the inputed parameter to control the infrared lamps.

III. BRIEF DESCRIPTION OF THE DRAWINGS

IV. DESCRIPTION OF THE PREFERRED EMBODIMENT

Figure 1:
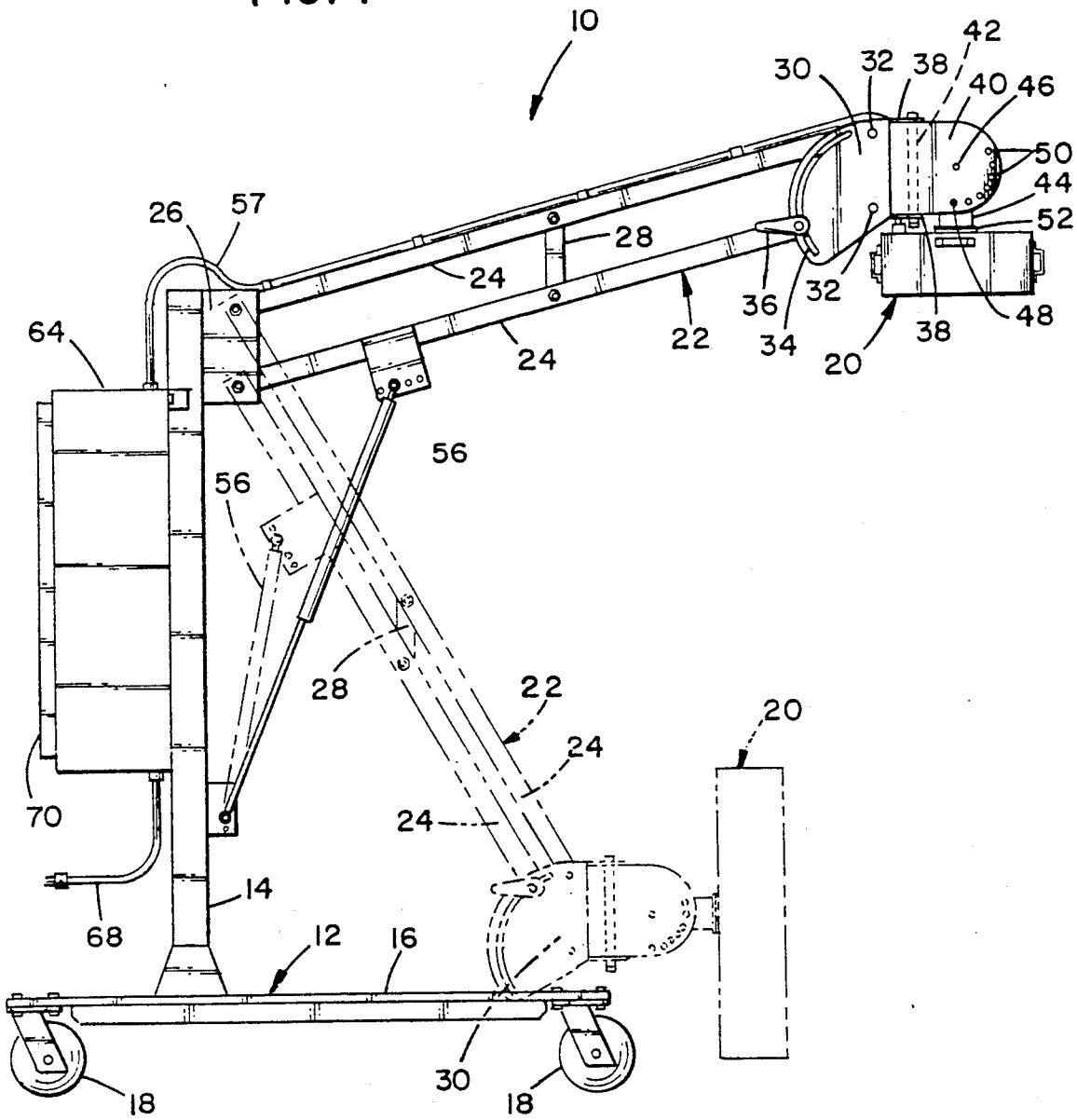
FIG. 1 is a side elevation view of an apparatus according to the present invention with alternate positioning of elements of the apparatus shown in phantom lines.

Referring now to the several drawing FIGS. in which identical elements are numbered identically throughout, a preferred embodiment of the present invention will now be described. Indicated at numeral 10, an apparatus is generally shown for heat treating an article body. Preferably, the apparatus 10 is for use with curing or otherwise heat treating an automobile finish.

The apparatus 10 includes a stand 12 having a vertical support post 14 carried on a support platform 16. The support platform 16 has attached to its underside wheels or coasters 18 which permit the stand 12 to be positioned adjacent an automobile.

The stand 12 carries an infrared heater 20. The heater 20 is attached to the support post 14 by an adjustably positionable support arm 22.

Shown in FIG. 1, support arm 22 comprises two parallel support rods 24. First ends of the support rods 24 are pivotably secured to a mounting bracket 26 carried on an upper end of vertical support post 14. The distal ends of the support rods 24 are pivotably connected to a position adjustment plate 30 to which the infrared heater is attached, as will be described. A linkage 28 connects the rods 24 at an intermediate location.

The plate 30 is pivotable connected to each of the support rods 24 by pivot pins 32. An arcuate slot 34 is formed in plate 30. Adjustment knob 36 is carried on a shaft which passes through slot 34 and is received in either of support rods 24. By tightening the adjustment knob 36, the relative positioning of support rods 24 can be fixed resulting in fixed positioning of the support arm 22 relative to the vertical support post 14. In FIG. 1, an alternative positioning is shown in phantom lines. It will be appreciated that a support arm 22 connected to a support post 14 as shown, forms no part of this invention per se and is described for ease of understanding of the present invention.

Plate 30 includes two vertically spaced apart tabs 38. An infrared heater mounting head 40 is provided with a vertical shaft 42 received between tabs 38 to head 40 to pivot about a vertical axis.

A head mounting bracket 44 is pivotable secured to mounting head 40 by a pivot pin 46. A retaining pin 48 extending through head mounting bracket 44 and into anyone of a plurality of holes 50 formed through mounting head 40. The retaining pin 48 permits the head mounting bracket 44 to be fixed in any one of a plurality of positions pivoted about the axis of pivot pin 46.

The infrared heater 20 is attached to the head mounting bracket 44 by a rotatable coupling 52. The coupling 52 permits heater 20 to be rotated about the longitudinal axis of the head mounting bracket 44.

As a result of the structure described, the apparatus 10 may be accurately positioned adjacent a surface to be heat treated. The adjustable arm 22 permits the heater 20 to be raised or lowered. The mounting head 40 permits the heater 20 to be pivoted relative to the stand 12. Further, the adjustable head mounting bracket 44 and rotatable coupling 52 permit the heater 20 to be pivoted and swiveled with respect to the mounting head 40. The combination of structure permits great flexibility in positioning of the infrared heater 20 relative to an automobile body.

It will be appreciated that the combination of elements thus described form no part of this invention per se and are described for the purposes of facilitating an understanding of the present invention.

Figure 4:
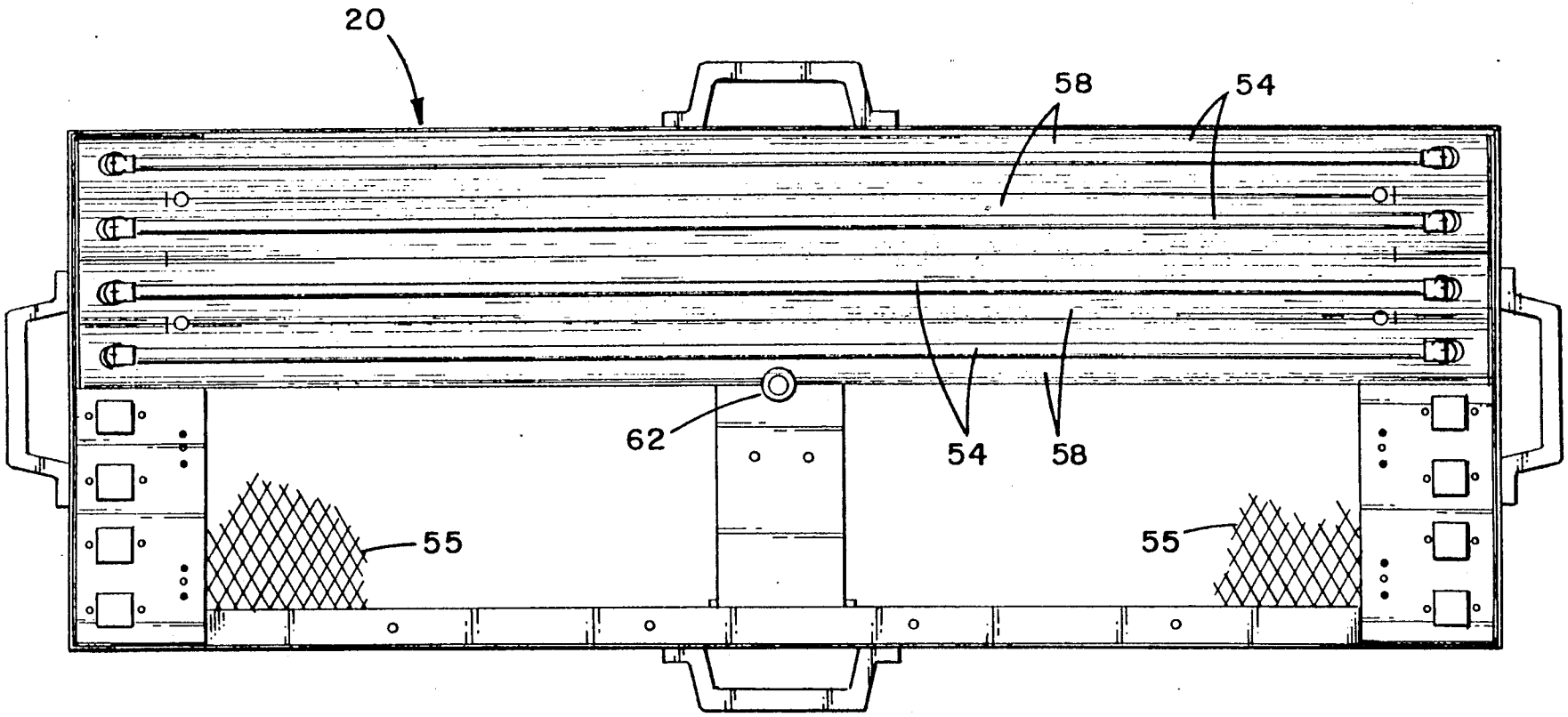
FIG. 4 is a front plan view, shown partially in section, of a infrared heater for use with the present invention.
Figure 5:
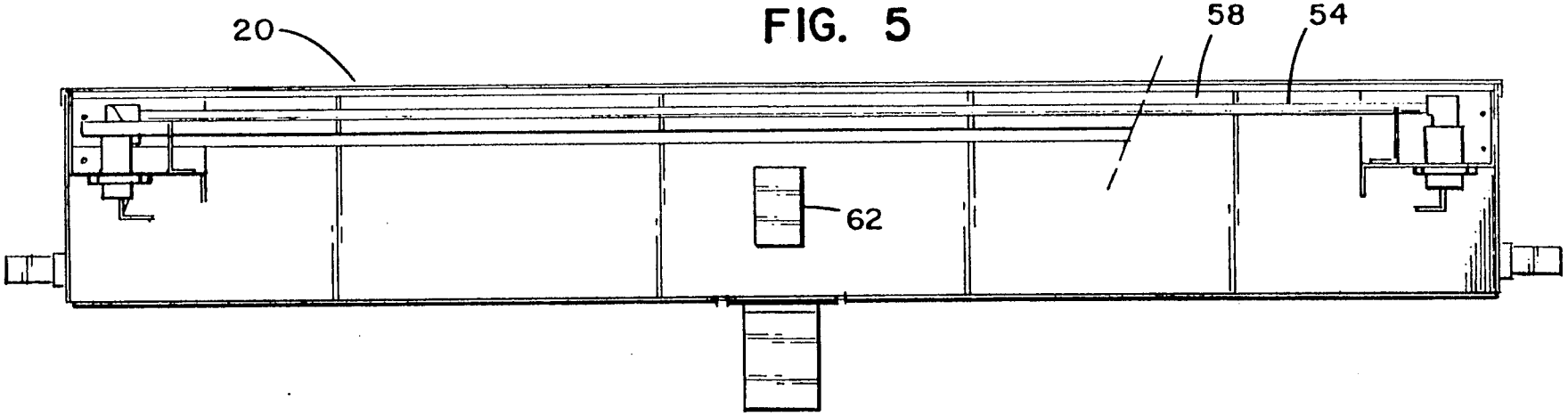
FIG. 5 is a side view of the heater of FIG. 4.
Figure 6:
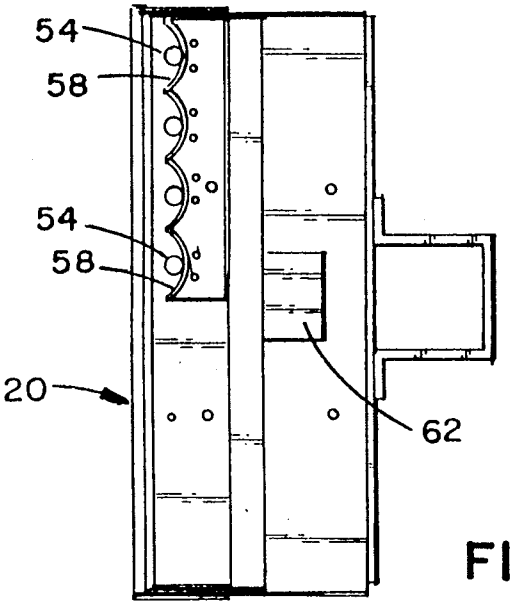
FIG. 6 is an end view of the heater of FIG. 4.

Shown best in FIGS. 4 through 6, infrared heater 20 carries a plurality of infrared lamps 54. To counter-balance the weight of the infrared heater 20, gas-filled piston assembly 56 is provided pivotably connected between vertical post 14 and support arm 22 (see FIG. 1).

The infrared heater 20 is generally box-like in configuration. The heater 20 contains a reflecting panel 58 in the form of parabolic reflecting troughs for reflecting radiation from lamps 54 toward the surface of an automobile body to be treated. For purposes that will become apparent, an optical pyrometer 62 is mounted in the heater 20 to be directed toward the surface being heat treated by the lamps 54. The optical pyrometer 62 senses the temperature of a surface which is being heat treated and transmits a signal indicative of the sensed temperature. It will be appreciated that optical pyrometers such as pyrometer 62 are commercially available.

Figure 2:
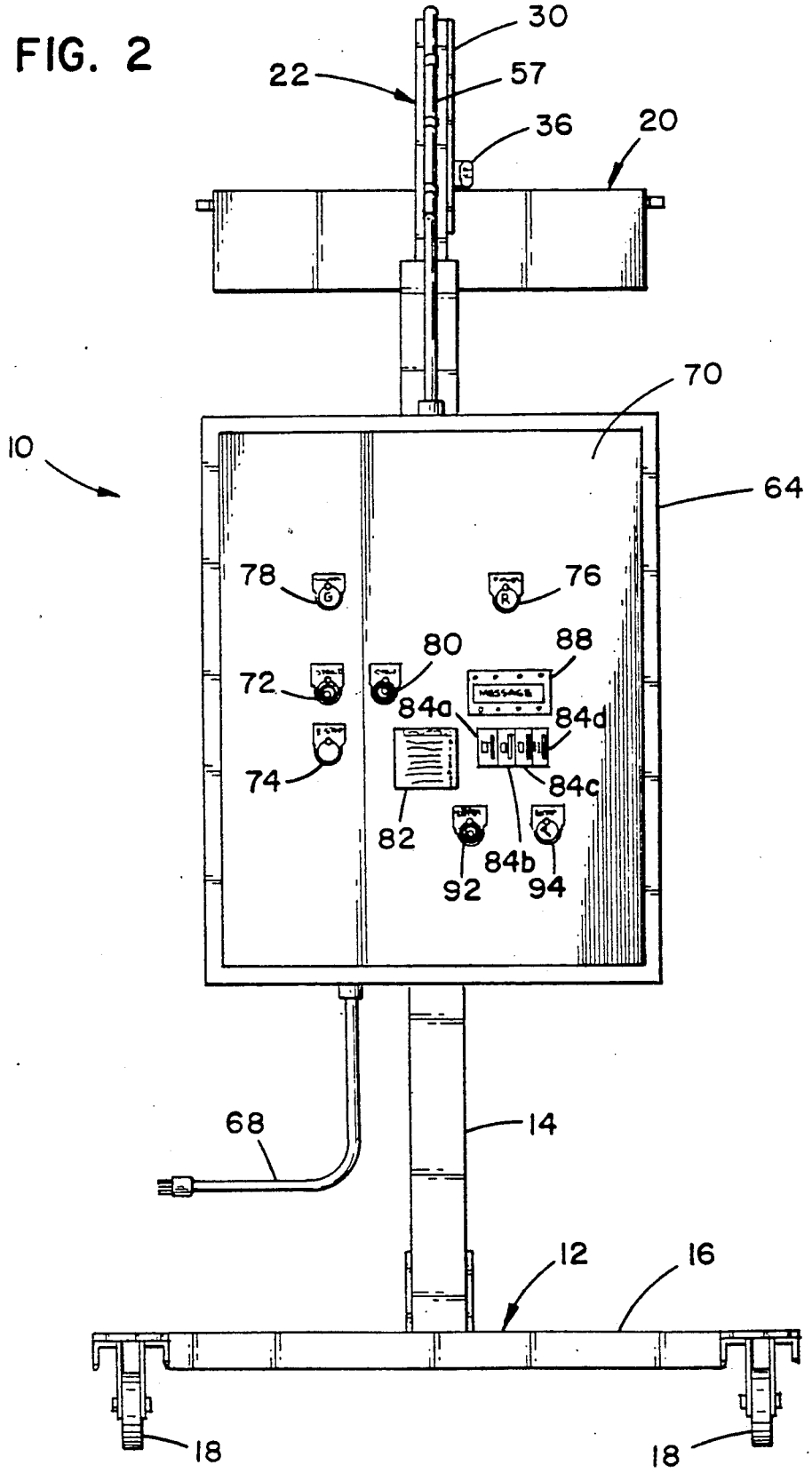
FIG. 2 is a rear elevation view of the apparatus of the present invention.

A control box 64 is carried on stand 12 (see FIGS. 1 and 2). Control box 64 contains circuitry for controlling the intensity of the infrared lamps 54. A cable 57 connects the circuitry of the control box 64 to the infrared lamps 54 and the optical pyrometer 62. Means, such as a conventional electrical plug 68, connects the circuitry of the control box 64 to a power source (not shown).

According to the present invention, the circuitry of the control box 64 includes means for inputting at least one parameter (but preferably a plurality of parameters) by which an operator can more accurately and thoroughly control the heating of an automobile body through use of the infrared lamps 54. Further, the control circuitry contained within box 64 includes a feed back loop by sensing, through optical pyrometer 62, the temperature of the surface being heat treated.

Figure 3:
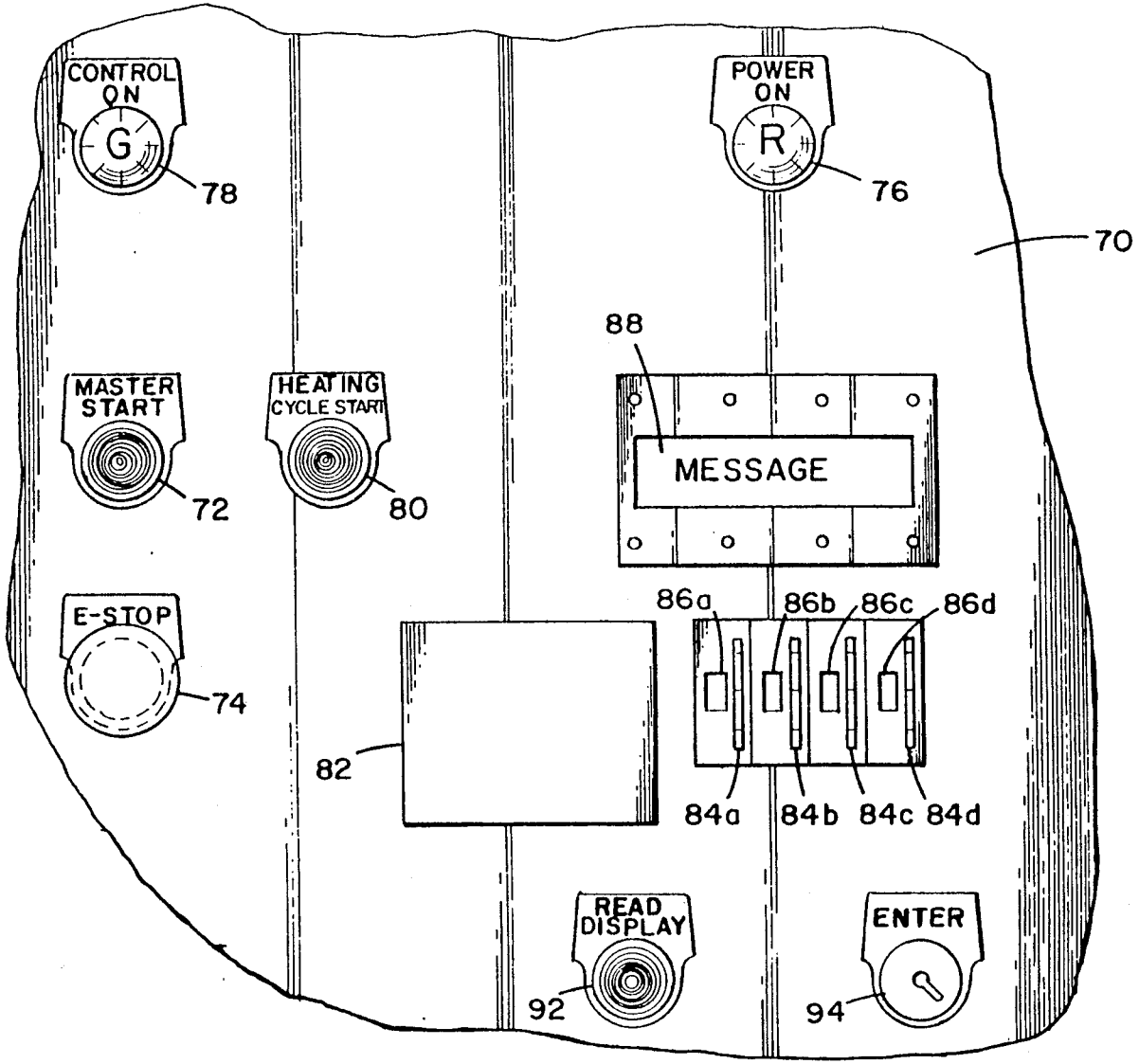
FIG. 3 is an enlarged view of a control panel of the apparatus of FIG. 2.

FIG. 3 is an enlarged view of the control panel 70 of control box 64. The control panel 70 contains input mechanisms and readout mechanisms for the control circuitry.

As shown, the control panel includes a main power-on button 72 (labelled "master start") for energizing the circuitry. An emergency off button 74 (labelled "E-stop") is provided to permit an operator to shut down all power to the apparatus 10. A first indicator light 76 is provided to illuminate when power is being provided to the apparatus 10. A second indicator light 78 is provided for illumination when power is being provided to the infrared lamps 54. A heating cycle start button 80 is provided to initiate the heating cycle.

The input elements of control panel 70 include parameter input mechanisms and a legend 82 provided for the convenience of an operator when inputting the control parameters or for viewing dynamic values during a heating cycle.

To input the parameters or call a dynamic display, four ten position thumb wheel switches **84*a*–84*d* each having readouts of zero through nine, one "read display" push button 92 and one key lock "ENTER" switch 94 are provided. It will be appreciated that thumb wheel inputs are well known in the art and are commercially available items. The operator selects the parameter to be viewed and or changed by setting its number, as determined by the list on nameplate 82, on the left most thumb wheel switch. There are ten parameters available as per the nameplate detailed as FIG. 3A. The operator can dial in any permutation of numbers between 000 and 999 on the three right most digits 84*b* through 84*d*. A main readout 88** is provided for displaying the value along with explanatory text.

Figures 3A, 7:
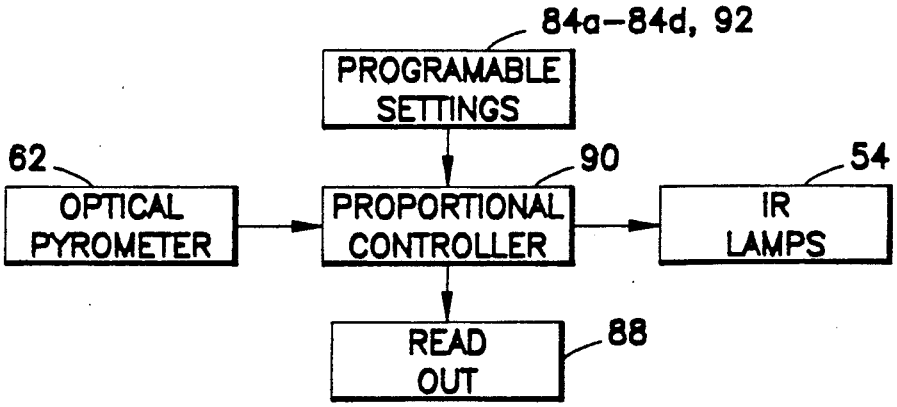
FIG. 3A is an enlarged view of the operator readable legend shown in FIG. 3.
FIG. 7 is a block diagram showing a circuit for controlling the apparatus of the present invention.

The input elements of control panel 74 are connected to the infrared lamps 54 through a proportion controller 90 (software shown schematically in FIG. 7). In FIG. 7, all inputs on panel 74 are shown schematically as item 74. Also, the optical pyrometer 62 is shown as an input to the proportional controller 90 which is shown controlling the infrared lamps 54.

It will be appreciated that proportional controller 90 having the functions such as will be described are commercially available items and form no part of this invention per se and that the programming of such controllers and the electrical connection of such controllers to inputs and outputs as will be described is within the skill of the art having the benefits of the teachings of the present application. Accordingly, for the remainder of the description of the control mechanism, applicants will describe the functions and inputs of the control mechanism. It will be understood that with the benefits of such description, one having ordinary skill in the art would be able to practice the teachings of the present invention.

The proportional controller 90 is selected so that an operator can input via thumb wheels **84*b*–84*d* the desired operating parameters of the infrared lamps 54 to achieve a desired temperature of a surface to be heat treated. By comparing the desired information to the actual temperature sensed through optical pyrometer 62, the controller 90 can vary the intensity of the lamps 54** to achieve the desired temperature.

As indicated on legend 82, an operator can input seven parameters: (1) a set point temperature, (2) a power limit, (3) a time, (4) a proportional band, (5) a manual reset, (6) a manual idle and (7) a manual cure. In addition, through use of main readout 88, an operator can read three parameters including a process variable (i.e. the temperature of the surface as detected by the optical pyrometer 62), a wattage variable (the percent power at which the infrared lamps are operating at the time of the reading) and an elapsed time (the amount of time elapsed during the heating cycle).

Input parameters 1 through 7 are inputted through use of the thumb wheels **84*a*–84*d*. The left most thumb wheel 84*a* is set to the value of the parameter being inputted (i.e. thumb wheel 84*a* is set at a value of 1 through 7 in order to make an input.) The remaining thumb wheels 84*b* through 84*d* are set at the desired value of the parameter being inputted. When the thumb wheels 84*a* through 84*d* are set at the desired value for an input, the operator enters the input by turning input entry key 94**.

If it is desired to read the value of any of parameters (i.e. the value of process variable, the wattage variable, the elapsed time or any of inputted parameters 1 through 7), the identifying number of the parameter is inputted through thumb wheel **84*a* and the parameter read button 92 (labelled "read display") is pressed by the operator. The value of that parameter is then displayed on the main readout 88**.

Each of the parameters is assigned a parameter identifying number which is inputted through thumb wheel 84*a*. The identifying number, parameter title and typical operating values and corresponding thumb wheel settings follow:

| Parameter No. | Parameter Title | Typical Thumb Wheel Setting | Parameter Value |
|---|---|---|---|
| 0 | Process Variable Deg. F. | (read only parameter) | (read only parameter) |
| 1 | Set Point Temperature Deg. F. | 1200 | 200 Deg. F. |
| 2 | Power Limit % | 2450 | 45% |
| 3 | Time at Temperature | 3010 | 10 Min. |
| 4 | Proportional Band % | 4100 | 10% |
| 5 | Manual Reset % of Band | 5450 | 45% |
| 6 | Manual Idle % Power | 6150 | 15% |
| 7 | Manual Cure % Power | 7500 | 50% |
| 8 | Wattage Variable/ % Power | (read only parameter) | (read only parameter) |
| 9 | Elapsed Time | (read only parameter) | (read only parameter) |

A discussion of the various parameters in relation with the proportional controller 90 follows:

A. Parameter No. 0—Process Variable Degrees F.

This is a read-only parameter. With the left most thumb wheel 84*a* set to 0 and the read display button 92 momentarily depressed, the main display 88 shows the actual surface temperature with updates every five seconds of the surface being heat treated by the apparatus 10 as read by the optical pyrometer 62.

B. Parameter No. 1—Set Point Temperature Degrees F.

This is a parameter which is inputted to the proportional controller 90 to indicate the desired temperature of the surface being heat treated. With the typical setting described above, if a surface temperature of 200 degrees is desired, the operator sets thumb wheels 84*a*–84*d* at the value 1200 and then engages key 94 to input a parameter value of 200° F. for parameter number 1. The operator may view the current setting by depressing the "read display" push button 92.

C. Parameter No. 2—Power Limit Percent

This is an inputtable parameter indicating the maximum power of the infrared lamps 54. A value of 900 would limit the output of the lamps 54 to 90% of their full output. To achieve the value of 900, an operator sets thumb wheels 84*a*–84*d* at the value 2900 and turns key 94. To set the maximum power at 45%, the operator would set the thumb wheels 84*a*–84*d* at the values 2450 and turn key 92. The operator may view the current setting by momentarily depressing the "read display" push button 92.

D. Parameter No. 3—Time at Temperature

This parameter indicates the desired amount of time at which the surface to be heat treated should be retained at the set point temperature inputted as parameter number 1. For example, if it is desired that the surface to be heat treated remain at 200 degrees for 10 minutes, the operator sets dials 84*a*–84*d* at 3010 and turns key 92. The operator may view the current setting by momentarily depressing the "read display" push button 92. (The desired temperature has previously been inputted by setting thumb wheels 84*a*–84*d* at 1200). The proportional controller is selected for the infrared lamps 54 to heat the automobile surface for time sufficient for the surface to attain the set point temperature of 200°. The controller 90 continues to power lamps 54 for a period of 10 minutes to retain the surface temperature at this set point temperature. As will be more fully described, the intensity of the infrared lamps 54 are being constantly monitored and varied in response to the temperature detected by optical pyrometer 62 to maintain the sensed temperature of the automobile body at or near the set point temperature.

E. Parameter No. 4—Proportional Band Percent

A proportional band percentage is a known feature in control loop circuitry. The proportional band is an area of temperature control. If the sensed temperature (via pyrometer 62) is below the proportional band, the heating elements 54 are full on. If the sensed temperature is above the proportional band, the infrared heaters 54 are at full off.

The proportional band is set as a percentage of the range (or span) of the proportional controller 90. For example, the controller has a range of 0°–400° F. A thumb wheel setting of 4100 set the the proportional band at 10% of the span. This makes the proportional band equal to 40° F.

It is recognized in closed loop control that a very narrow proportional band (ie. 10° F.) may cause a high temperature overshoot and oscillation in the heater (resulting in the lamps being bright, and dim, and bright, and dim alternately). A large proportional band will cause the proportional action to begin at a lower temperature and result in a slow down in reaching the set point temperature. By proportional action, it would be recognized by those skilled in the art that the intensity of the lamps 54 in the proportional band is varied to intermediate values between full on and full off.

F. Parameter No. 5—Manual Reset Percent of Band

Manual reset (similar to integral control) is used to position the proportional band relative to the set point. The manual reset is analogous to the percentage of available power necessary to maintain the process at set point. (The available power is set by parameter No. 2—power limit percent).

During heating, and after the process is stabilized, if the process variable (ie. the temperature sensed by pyrometer 62) and the set point are not the same (or within a few tolerable degrees of each other), the manual reset is used to shift the proportional band to bring them closer together. Manual reset along with proportional band and power limit can also be used to control process variable overshoot. If the temperature overshoots the set point when the proccess is first turned on, the proportional band can be increased, manual reset increased and power limit increased to cause the proportional action to start at a lower temperature to control over shoot. The manual reset value is set as a percentage of the power limit.

The use of proportional band and manual reset in closed loop control is known and an understanding of interaction of the two is within the skill of the art of proportional control. To illustrate the interaction of proportional band in manual reset the readers attention is directed to FIGS. 8 and 9.

Figure 8:
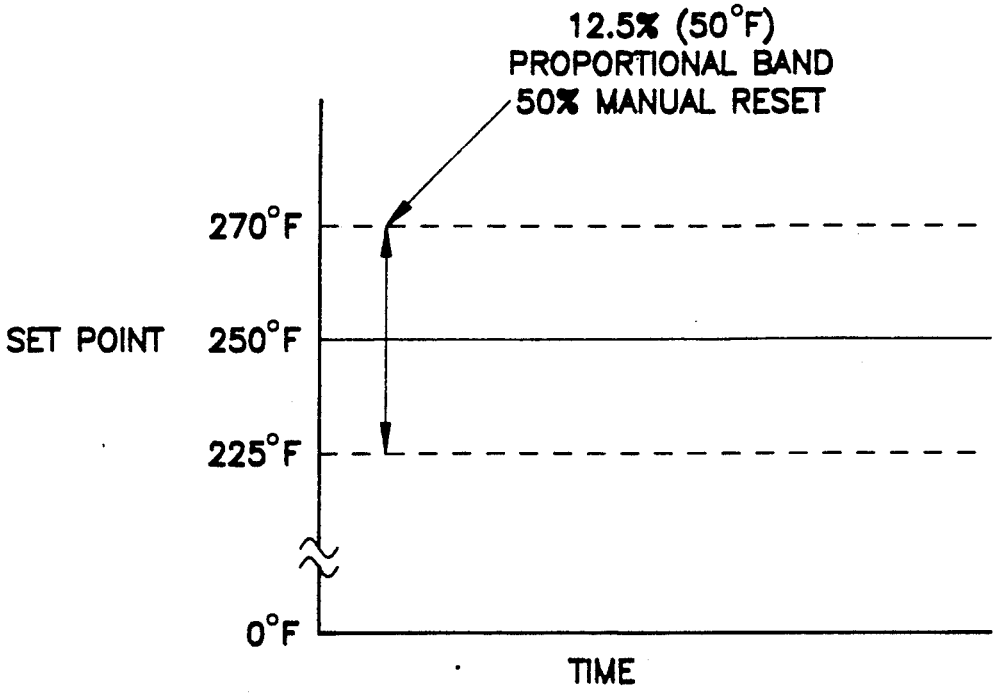
FIGS. 8 and 9 are graphs showing aspects of the control of the present invention.
Figure 9:
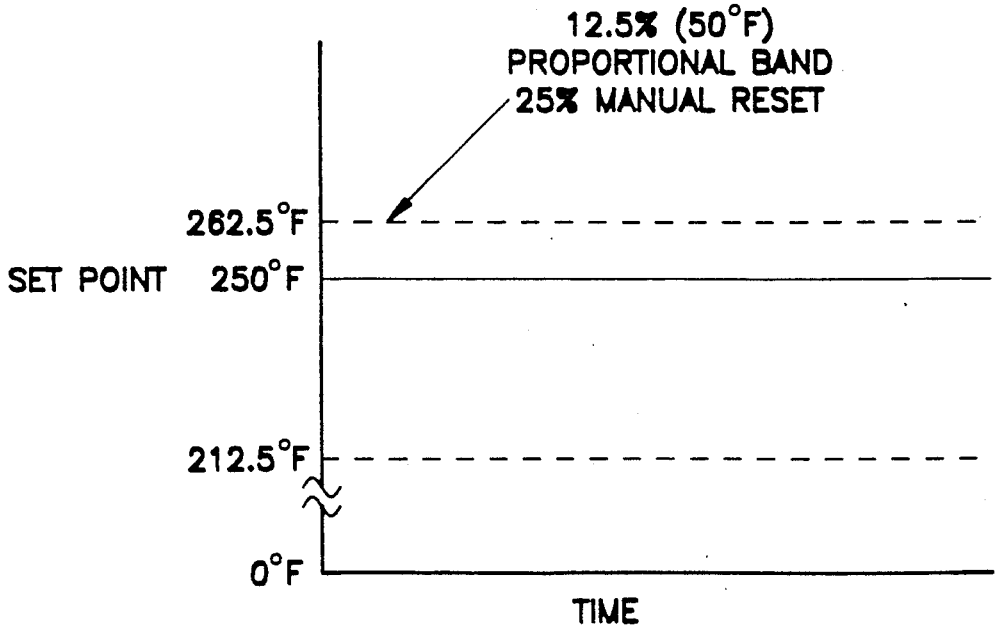

In FIGS. 8 and 9, a desired set point of 250° is shown. FIG. 8 shows a 12.5% proportional band (ie. a band of 50° F. for a 400° controller span) with a 50% manual reset. As shown in FIG. 8, the consequence of a 50% manual reset means that half of the proportional band is positioned above the set point and half of the proportional band is positioned below the set point. As a result, if the pyrometer 62 senses a temperature of below 225° F., the power to the infrared lamps 54 is full on (limited only by the power limit of parameter No. 2). Alternatively, if the optical pyrometer 62 senses a temperature in excess of 275° F., the infrared lamps are full off. Within the proportional band range (ie. between 225° F. and 275° F.), the intensity of the lamps 54 is controlled by the proportional controller 90 in response to the position of the process variable relative to the proportional band. By examining FIG. 8, the reader will note that a very narrow proportional band will lead to temperature overshoots and oscillations in the intensity of the lamps.

FIG. 9 illustrates the consequence of varying the manual reset. In FIG. 9, a manual reset of 25% is shown. As a result, 25% of the proportional band is positioned above the set point with the remaining area of the proportional band positioned below the set point.

G. Parameter No. 6 —Manual Idle Percent Power

The use of manual idle is selected by an operator to eliminate the automatic control of the lamps 54. As a result, no proportional control is used. Instead, the infrared elements 54 are shut off only by pressing the emergency stop button 74. The manual idle is selected to have a maximum setting of 30% of the maximum heating power of the infrared lamps regardless of any thumb wheel setting over 30%. If it is desired for a manual idle to be operating at 25% of maximum power, the operator dials 6250 on thumb wheels 84*a*–84*d* and turns switch 94. When manual operation is stopped by operating the emergency stop button 74, the manual idle hold logic is reset so that the proportional control could be selected after the master control is restarted.

H. Parameter No. 7 —Manual Cure Percent Power

The manual cure is similar to the manual idle except that the manual cure does not have 30% maximum heater power. Instead, the maximum manual cure can be set with a heater power range of zero to 99.9%. For example, a manual operation at 90% power is achieved by dialing 7900 into thumb wheels 84*a*–84*d* and turning key 94. The infrared lamps 54 will now heat at 90% of their power until stopped by the operator engaging emergency stop 74. Upon engagement of emergency stop 74, the heater will shut down completely. The master control logic must be restarted for any subsequent operation of the heater.

I. Parameter No. 8 —Wattage Variable/%Power

This is a read only parameter. By setting the left most thumb wheel 84*a* at 8 and momentarily depressing the display button 92, the current wattage and percent power will be displayed on main display 88 with updates every five seconds.

J. PARAMETER NO. 9 —ELAPSED TIME

This is a read only parameter. If the left most thumb wheel 84*a* is set to 9 and the readout display button 92 is momentarily pressed, the time elapsed since the start of the heating cycle would be displayed, with updates every five seconds. The time is measured when the process variable (i.e., the temperature sensed by parameter 62) is within 10 degress of the set point).

Automatic Operation

After all parameters have been set, the heating cycle is started by depressing heating cycle start button 80. When the time as set by parameter No. 3 has been completed, the heater turns itself off. For the automatic heating cycle to operate, all settable parameters 1 through 5 must have values entered.

The above describes the desired functions of the proportional controller 90. It will be appreciated by those skilled in the art that proportional controllers capable of achieving the above functions are well within the skill of the art. For example, a suitable microprocessor for the proportional control software is the General Electic Series One Plus programmable controller. It is within the skill of the art to draft software to control the process utilizing the controller.

Having described the present invention with reference to a preferred embodiment, it has been shown how the objects of the invention have been obtained. However, the foregoing is a description of a preferred embodiment of the present invention. It is intended that the scope of the present invention will not be limited to a preferred embodiment but will include all modifications and equivalents thereof.

What is claimed is:

1. An apparatus for heat treating a surface of a body, said apparatus comprising:

at least one infrared lamp;

a stand for mounting said lamp in any one of a plurality of positions opposing a surface to be heat treated;

power connect means for connecting said lamp to a source of electrical power;

heat detection means for detecting a temperature of said surface;

circuit means for controlling the energization of said lamp, said circuit means including parameter input means for permitting an operator to input at least one operating parameter, said circuit means further including proportional control means responsive to said heat detection means and responsive to said parameter input means to control said lamp;

said circuit means including input means for inputting a desired temperature of said surface, said circuit means further including means for comparing said desired temperature to a temperture detected by said heat detection means, said proportional control means including said tolerance including means for defining a proportional band surrounding said desired temperature with said circuit means proportionately controlling said intensity when said detected temperature is within said band.

2. An apparatus according to claim 1 wherein said proportional control means and said parameter input means includes means for inputting said proportional band to said proportional control means to identify a maximum proportional control area surrounding said desired temperature.

3. An apparatus according to claim 2 comprising means for inputting a manual reset to said proportional control means to vary a positioning of said proportional band relative to said desired temperature.

4. An apparatus according to claim 1, wherein said stand includes means permitting said stand to be moved toward and away from said surface to be heat treated.

5. An apparatus according to claim 4 comprising adjustable positioning means connecting said lamp to said stand for said lamp to be adjustably positioned and held in a predetermined desired position while heating treating said surface.

6. A repair arm of automotive finishes, comprising:

a panel of infrared lamps arranged to project thermal energy against an automobile body;

a stand movable on a work surface for positioning said infrared lamps against said automobile body;

an adjustable support arm connecting said lamps to said stand for raising and lowering said lamps relative to said stand;

an optical pyrometer carried adjacent said lamps for movement therewith and positioned to detect a temperature of a surface being heated by said lamps;

a circuit for controlling the energization of said lamps including a parameter input means for permitting an operator to input at least one operating parameter to said circuit and a proportional control software responsive to said optical pyrometer and said parameter input means to control an intensity of said lamps;

said parameter input means includes means for inputting a desired set point temperature of said body being heat treated with said proportional controller selected to vary an intensity of said lamps in response to a difference between said set point and said detected temperature, said proportional controller including a means for defining proportional band surrounding said set point temperature; said proportional controller proportionately controlling said intensity of said lamps when said detected temperature is within said band.

7. An apparatus according to claim 6 wherein said parameter input means includes means for inputting a time at temperature parameter with said proportional controller selected to maintain said detected temperature within said predetermined tolerance for a time equal to said inputted time.

* * * * *

UNITED STATES PATENT AND TRADEMARK OFFICE

CERTIFICATE OF CORRECTION

PATENT NO. : 5,050,232

DATED : September 17, 1991

INVENTOR(S) : Charles H. Bergman, et al.

It is certified that error appears in the above-identified patent and that said Letters Patent is hereby corrected as shown below:

In the claims, claim 1, column 8, line 55, cancel "including said tolerance";

In the claims, claim 7, column 10, line 22, cancel "said" and insert ---a---.

Signed and Sealed this

Twentieth Day of April, 1993

*Attest:*

MICHAEL K. KIRK

*Attesting Officer*

*Acting Commissioner of Patents and Trademarks*